United States Patent [19]

Nishimura

[11] Patent Number: 4,631,225

[45] Date of Patent: Dec. 23, 1986

[54] RUBBERIZED FABRIC

[75] Inventor: Akira Nishimura, Osaka, Japan

[73] Assignee: Sumitomo Electric Industries, Ltd., Osaka, Japan

[21] Appl. No.: 706,991

[22] Filed: Feb. 28, 1985

[30] Foreign Application Priority Data

Mar. 6, 1984 [JP] Japan ..... 59-43145

[51] Int. Cl.[4] ..... B05D 1/36; B32B 25/04; B32B 25/10; B65D 85/84

[52] U.S. Cl. ..... 428/250; 206/524.2; 206/524.6; 220/470; 220/DIG. 11; 244/135 B; 427/412; 428/252; 428/261; 428/267

[58] Field of Search ..... 427/412; 428/250, 252, 428/261, 267; 206/524.2, 524.6; 220/DIG. 11, 470; 244/135 B

[56] References Cited

U.S. PATENT DOCUMENTS

| | | | |
|---|---|---|---|
| Re. 23,451 | 1/1952 | Mighton et al. | 428/267 |
| 2,128,635 | 8/1938 | Hale et al. | 428/460 |
| 2,816,055 | 12/1957 | Semegen et al. | 428/250 |
| 3,227,603 | 1/1966 | Kraiman | 428/261 |
| 3,483,075 | 12/1969 | Schmitt | 428/267 |
| 2,713,550 | 7/1955 | Reid et al. | 428/252 |
| 4,149,921 | 4/1979 | Stannard | 244/135 B |
| 4,215,171 | 7/1980 | Marco et al. | 428/252 |
| 4,338,370 | 7/1982 | Suter | 428/267 |

FOREIGN PATENT DOCUMENTS

| | | |
|---|---|---|
| 660677 | 4/1963 | Canada . |
| 13949 | 4/1971 | Japan . |
| 48006 | 6/1980 | Japan . |

*Primary Examiner*—James C. Cannon

*Attorney, Agent, or Firm*—Sughrue, Mion, Zinn, Macpeak and Seas

[57] ABSTRACT

An oilproof rubberized fabric is described, comprising a woven fabric as a strength member and having coated thereon an oilproof synthetic rubber, wherein simplicity of construction and ease of fabrication and symmetry of structure and physical properties on both sides of the woven fabric are attained by means of a resin having an oil-barrier property and an adhesive property applied so as to fill up interstices in the woven fabric.

10 Claims, 4 Drawing Figures

RUBBERIZED FABRIC

FIELD OF THE INVENTION

This invention relates to a rubberized fabric, and more particularly to a rubberized fabric for use, e.g., in a flexible fuel container or in a flexible partition of rubberized fabric disposed in one oil product container (of rigid outer shell) to permit simultaneous storage of at least two oil products.

BACKGROUND OF THE INVENTION

Rubberized fabric to be used in flexible oilproof containers generally had a construction as illustrated in FIG. 1. In this construction, for example, a coating of an oilproof synthetic rubber 2 (such as nitrile rubber or urethane rubber) is applied on each side of a woven fabric of nylon 1.

Where a container using a diaphragm and having fuel oil as its container is desired to curb loss of the fuel oil due to permeation through the diaphragm with great exactitude or where the thickness or weight of the diaphragm is specifically desired to be decreased, however, the rubberized fabric is produced in a construction as illustrated in FIG. 2. In this construction, an adhesive agent layer 4 for the composition is superposed on a rubber layer 2 applied as a coating on at least one side of the woven fabric, a resin layer (called a "barrier" layer) 3 for curbing passage of fuel oil is superposed on the adhesive agent layer 4, an adhesive agent layer 4 is again superposed, and an outermost rubber layer 2 is deposited as a coating thereon. The barrier 3 constitutes itself a continuous face and the rubber layers 2 on both sides of the barrier function to protect the barrier. The interlayer adhesive 4 selected in view of the composition of the rubber 2 and the barrier 3. The woven fabric 1 in either of the constructions of FIG. 1 and FIG. 2 is treated with adhesive agent for the purpose of composition with the rubber layers 2 on both sides thereof.

By this construction, the loss of fuel oil due to permeation through the diaphragm can be curbed and the thickness and/or weight of the diaphragm can be reduced. The construction nevertheless entails the following drawbacks.

(1) The rubberized fabric is expensive.

As is apprent from the construction, the production of this rubberized fabric calls for many steps of operation. More often than not, the adhesive agent layers and the barrier are required to have a limited thickness falling generally in the range of 20 to 50 μm. Thus, the operation necessitates an advanced coating technique and many steps (because of many applications each in as small a thickness as permissible) or a laminating technique.

(2) Lack of structural or physical symmetry between the opposite sides of woven fabric Generally, due to cost, the adhesive agent layer and the barrier are each formed only on one of the sides of the woven fabric. Thus, the two sides of the rubberized fabric are structurally asymmetrical relative to the woven fabric. When the rubberized fabric is folded over itself, for example, the barrier and the adhesive agent layer which have relatively high rigidity are liable to gather stress possibly so much as to sustain breakage.

Further, the side of the rubberized fabric containing the adhesive agent layer and the barrier has a rubber content proportionately lower because of the presence of these layers. At low temperatures, the overall rigidity of this side of the rubberized fabric is so high that the side is liable to sustain cracks if the rubberized fabric is folded.

SUMMARY OF THE INVENTION

This invention has resulted from extensive investigation devoted to overcoming the drawbacks suffered by the prior art as described above. More specifically, this invention is directed to an oilproof rubberized fabric comprising a woven fabric as a strength member and having coated thereon oilproof synthetic rubber, wherein a resin having an oil-barrier property and an adhesive property is applied so as to fill up interstices in the woven fabric (i.e., between adjacent filaments and between adjacent yarns).

Further objects and features of this invention will become apparent to those skilled in the art based on the following description of a preferred embodiment of the invention, as illustrated in the accompanying drawings.

DETAILED DESCRIPTION OF THE INVENTION

This invention is described in detail below with reference to the accompanying drawings.

Figure 3:
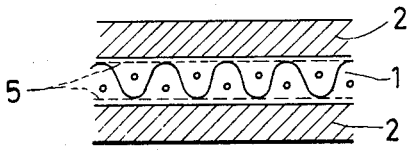
FIG. 3 illustrates a rubberized fabric of this invention.

FIG. 3 illustrates the construction of a rubberized fabric of the present invention. In this construction, a combination barrier and adhesive agent 5 sparingly pervious to fuel oil and capable of adhering to a woven fabric 1 and a coating rubber 2 is directly applied in advance in a very small thickness on the woven fabric 1 and a coating of oilproof rubber 2 is superposed as a coating on the woven fabric treated with the combination barrier and adhesive agent as described above to provide an oilproof rubberized fabric highly capable of curbing passage of e.g., fuel oil.

The rubberized fabric of this construction is capable of curbing loss of fuel oil due to permeation with great exactitude and is very simple in construction. The method of fabrication adopted for production of the present invention is not gretly different from the conventional method. As the result, the rubberized fabric of this invention enjoys high cost performance with reference to the oil-barrier property and the adhesive property required for the composition.

Figure 1:
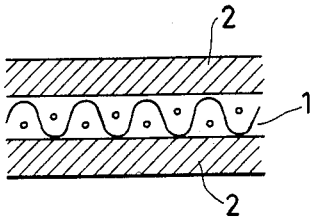
FIG. 1 PRIOR ART
FIG. 1 and FIG. 2 each illustrates a conventional rubberized fabric.
Figure 2:
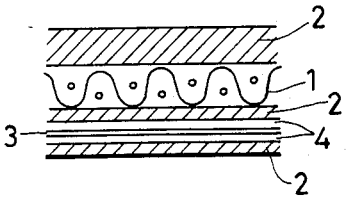
FIG. 2 PRIOR ART

Unlike the rubberized fabric of FIG. 2 a uniform rubber layers can be formed on each the side of the woven fabric because the barrier serves concurrently as adhesive agent and it can be directly applied in an extremely small thickness on the woven fabric. Since foreign portions (which may be otherwise called layers) can be concentrically formed wholly in the woven fabric portion, the opposite sides of the produced fabric are equal to each other and the otherwise inevitable structural asymmetry between the opposite sides of the woven fabric is eliminated. As a result, the rubberized fabric no longer suffers from the absence of symmetry in terms of physical properties and from the susceptibility to structural faults caused when the fabric is folded.

Concrete examples of the combination barrier and adhesive agent advantageously usable herein include resins formed preponderantly of vinylidene chloride-acrylonitrile copolymer (a product marketed under trademark designation "Saran" such as "Saran R-202" and "Saran F-216" manufactured by Asahi Kasei Kogyo Kabushiki Kaisha), soluble nylons such as a product marketed under trademark designation "Elvamide 8061" by E. I. Du Pont De Nemours & Co., and phenols such as a product marketed under trademark "TyPlyBN" by Lord Hughson Chemicals. The optimum amount of the combination oil-barrier and adhesive agent applied on the woven fabric is determined in consideration of the effect of curbing permeation, the adhesive strength, and the overall rigidity (i.e., excessive stiffness is undesirable). Generally, this amount preferably exceeds at least 20 μm in terms of average thickness (=weight/specific gravity/area). The amount of the agent, i.e., the thickness of the rubber layer can be as large as possible when the hardness is not questioned. However, generally, the thickness is preferably 20 to 100 μm and more preferably 30 to 70 μm. Where the combination barrier and adhesive agent is used as contemplated by this invention, i.e., when this agent is applied by the aforementioned method of fabrication in an amount of not more than about 100 μm in terms of thickness of the applied layer, the aforementioned oil-barrier material and the adhesive material may be suitably applied alternately or they may be applied collectively in a mixed state. It is preferred that the texture of the woven fabric be so fine that the rubber layers coated on opposite surfaces of the fabric cannot penetrate the interstices thereof.

In the construction as described above, since the resin (combination barrier and adhesive agent) is applied directly upon the woven fabric having a rugged surface, there are times when the barrier of completely continued web as illustrated in FIG. 2 may not be produced. Consequently, there are times when the degree of permeation of this barrier may not be equal to that of the barrier in the construction of FIG. 2. Nevertheless, the barrier applied in a very small amount (e.g., a few percents by weight based on the total weight of the rubberized fabric) is highly effective in curbing the permeation of fuel oil therethrough. For example, a "permeability of not more than 0.1 oz/ft$^2$ day" as specified by MIL-T-52983 for a membrane in a flexible fuel oil container can be amply satisfied (see Table 1 below).

Figure 4:
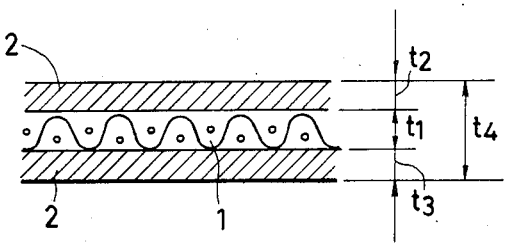
FIG. 4 is an explanatory diagram illustrating a rubberized fabric used in the experiment embodying the present invention.

Now, test results will be cited below for the purpose of aiding in comprehension of the present invention. A rubberized fabric construction as illustrated in FIG. 4 was prepared, tested for permeation of the fuel oil (isooctane/toluene=60/40 (v/v)) and, after standing in the fuel oil, tested for adhesive strength (peeling test at 180°). The results are shown in Table 1. In the diagram of FIG. 4. 1 stands for nylon fabric, 2 for nitrile rubber, t1 for 0.55 mm, t2 for 0.3 mm, t3 for 0.4 mm, and t4 for 1.25 mm.

All the combination barrier and adhesive agents indicated in the left-hand column of Table 1 were prepared in the form of about 15% solids solution and applied to the nylon fabric by dipping. The amount of application was about 30 to 50 μ/m$^2$.o in terms of average thickness.

TABLE 1

| Degree of Permeation And Adhesive Strength | | |
|---|---|---|
| Combination Barrier And Adhesive Agent*1 | Degree of Permeation*2 (oz/ft$^2$ day) | Adhesive Strength*3 (kg/25 mm of width) |
| None | 0.50 | 0.7 |
| Saran Type | 0.02 | 8.5 |
| Methoxylated Nylon Type | 0.02 | 5.5 |
| Copolymerized Nylon Type | 0.08 | 6.8 |
| Copolymerized Nylon/Phenol Resin Type | 0.01 | 6.0 |

*1Fuel oil tested: Isooctane/toluene = 60/40 (v/v)
*2Method for measurement of degree of permeation: MIL-T-52983, 4, 6, 2, 12 Diffusion Rate
*3Method for measurement of adhesive strength: ASTM D 413, immersion in test fuel oil *1 at 70° C. for 14 days Thus, based on the foregoing description, it is seen that invention brings about the following effects.

(1) The construction of the rubberized fabric is simple, and therefore the number of steps of operation in preparation is small. The production of the rubberized fabric can be effected by any of the conventional ordinary procedures of fabrication such as, for example, dipping (or spreading) and calendering. Thus, the product can be produced economically.

(2) The oil-barrier concurrently serves as adhesive agent and can be quickly applied in a very small thickness on the woven fabric without being maldistributed on one side of the woven fabric. The oilproof rubber deposited on the oil-barrier, therefore, is allowed to form a uniform layer. No asymmetry of physical properties occur between the opposite sides of the fabric.

While the invention has been described in detail and with reference to specific embodiment thereof, it will be apparent to one skilled in the art that various changes and modifications can be made therein without departing from the spirit and scope thereof.

What is claimed is:

1. An oil-proof rubberized fabric comprising (a) a woven fabric as a strength member having coated thereon (b) an adhesive resin substantially impermeable to oil applied so as to provide a uniform coating layer over said woven fabric by dip-coating, and said adhesive resin having coated thereon (c) an oil-proof synthetic rubber layer on each side substantially symmetrical relative to said woven fabric.

2. A oil-proof rubberized fabric according to claim 1, wherein said adhesive resin substantially impermeable to oil comprises as a principle component at least one member selected from the group consisting of vinylidene chlorideacrylonitrile copolymer, soluble nylons and phenolic compounds.

3. A oil-proof fabric according to claim 2, which is used in a flexible container for fuel, comprising a woven fabric of nylon fibers as the woven fabric part and a nitrile rubber or polyurethane rubber as the coating synthetic rubber part.

4. An oil-proof rubberized fabric according to claim 1, wherein the adhesive resin substantially impermeable to oil is applied so as to have an average thickness of at least 20 μm (equal weight/specific gravity/area).

5. An oil-proof rubberized fabric according to claim 4, wherein the average thickness of the adhesive resin applied is 20 to 100 μm (equal weight/specific gravity/area).

6. An oil-proof rubberized fabric according to claim 5, wherein the average thicknes of the adhesive resin applied is 30 to 70 μm (equal weight/specific gravity/area).

7. An oil-proof rubberized fabric according to claim 2, wherein the adhesive resin substantially impermeable to oil is applied so as to have an average thickness of at least 20 μm per an (equal weight/specific gravity/area).

8. An oil-proof rubberized fabric according to claim 7, wherein the average thickness of the adhesive resin applied is 20 to 100 μm (equal weight/specific gravity/area).

9. An oil-proof rubberized fabric according to claim 8, wherein the average thicknes of the adhesive resin applied is 30 to 70 μm (equal weight/specific gravity/area).

10. An oilproof rubberized fabric according to claim 2, wherein said soluble nylons comprise at least one member selected from the group consisting of an alkoxylated nylon and a copolymerized nylon.

* * * * *